United States Patent [19]

Strong

[11] Patent Number: 5,060,873

[45] Date of Patent: Oct. 29, 1991

[54] WOOD CHIPPER FIN CHIP SEPARATOR

[75] Inventor: Donald E. Strong, Remus, Mich.

[73] Assignee: Strong Manufacturing, Remus, Mich.

[21] Appl. No.: 527,041

[22] Filed: May 21, 1990

[51] Int. Cl.[5] ..... B02C 18/22

[52] U.S. Cl. ..... 241/55; 241/92; 144/176

[58] Field of Search ..... 144/176; 241/92, 101.7, 241/55

[56] References Cited

U.S. PATENT DOCUMENTS 2,679,873 6/1954 Hill .
3,000,411 9/1961 Ealet .
3,032,281 5/1962 Wexell .
3,276,700 10/1966 Eklund .
3,384,311 5/1968 Eklund et al. .
3,524,485 8/1970 Smith .
3,635,410 1/1972 Smith .
3,844,489 10/1974 Strong .
4,719,950 1/1988 Peteson et al. .
4,951,882 8/1990 Ober ..... 241/92 X

*Primary Examiner*—Mark Rosenbaum
*Attorney, Agent, or Firm*—Price, Heneveld, Cooper, DeWitt & Litton

[57] ABSTRACT

In a wood chipping machine having a rotating cutter disk, a wood chip separator comprising a plurality of fins attached to the back of the cutter disk, near the perimeter, for deflecting wood chips axially away from the cutter disk to minimize the cross over of wood chips to the infeed side of the cutter disk and to minimize the discard of wood chips with wood chaff.

27 Claims, 2 Drawing Sheets

WOOD CHIPPER FIN CHIP SEPARATOR

BACKGROUND OF THE INVENTION

The present invention generally relates to rotary wood chippers and specifically relates to chip separators used with rotary wood chippers.

Rotary wood chippers are large, heavy machines and are commonly built with an integrated trailer towing frame for portability to a job site. An infeed chute with a powered conveyor is often provided for feeding material, typically a tree, into the front side of a cutter disk.

The cutter disk is the heart of a wood chipper and is typically a thick metal disk with at least a pair of cutter knives which are mounted adjacent chip slots in the disk. The disk is rotated at relatively high speed and is typically mounted in a cylindrical chamber and at an acute angle to the direction of feed, such that the knives tend to draw the material into the disk. As the material is fed into the front side of the disk, the knives continuously slice the end of the material to form chips which pass through the chip slots to the back of the disk. The chips are removed from the back of the disk in part by centripetal force. Fan blades which are typically mounted on the back of the disk induce an airflow which also removes the chips from the back of the disk and which carries the chips through a tangential chip chute for discharge from the chipper. Such wood chippers typically have an internal combustion engine, also mounted on the integrated frame, to power the cutter disk and the infeed conveyor.

Some materials, such as grit, leaves, needles and small branches, are not cut and remain on the front side of the disk where they are discarded as chaff. Because of the forces generated at the back of the disk, chips are frequently forced past the edge of the disk to the front of the disk, where they are discarded with the chaff which is costly to the chipper operator.

While attempts have previously been made in trying to minimize the crossover of chips and their loss by discard with chaff, these attempts have proven expensive, ineffective or otherwise impractical. One approach has been to use a divider bar circumscribing the perimeter of the disk to block the passage of chips past the disk edge. The divider bar is basically a flat bar bent edgewise into a ring and mounted in the cutter disk chamber to the chamber wall which circumscribes the cutter disk. The divider bar projects into the chamber and is positioned adjacent the back of the disk. A notch can be ground into the back of the disk, near its perimeter and circumscribing the disk, such that the bar will be fit into the notch. Another approach uses a divider bar and a groove circumscribing the perimeter of the disk to close off the passage of chips around the edge of the disk. This is similar to the above approach except that a groove is ground into the edge of the disk, circumscribing the disk, and the divider bar projects into this groove. These attempts have commonly focused upon closing the gap between the perimeter edge of the cutter disk and the adjoining wall of the chamber in which the disk is mounted. However, chips still pass around the disk edge to the front side in spite of these attempts to minimize this occurrence. Further, such structures require close manufacturing tolerances. While the required tolerances can be acquired during manufacturing, but at a significant cost, wear from the rugged duty encountered by these machines quickly degrades these tolerances and frequent adjustments and alignments are required. Further, such systems require expensive installation procedures as well as frequent and therefore costly maintenance.

SUMMARY OF THE INVENTION

The present invention addresses and resolves these problems by providing a relatively inexpensive, maintenance free chip separator structure. A chip separator embodying the present invention includes a cutter disk having a plurality of spaced fins extending from the discharge side of the disk, near the periphery thereof, for deflecting and winnowing good chips from wood chaff. According to one aspect of the invention, the fins are mounted in equally spaced and angled relationship adjacent the perimeter, on the back of the cutter disk to force the cut chips in an axial direction away from the disk edge for discharge from the chute.

The present chip separator does not require fine tolerances, thus holding manufacture and maintenance costs down. The present chip separator is easily added to virtually any standard cutter disk since it does not require a special chip separator disk. Good chip loss is significantly reduced by the present chip separator, enhancing the efficiency of the chipper. Further, as the present chip separator does not rely on close tolerances to perform the chip separating task, the performance of the present chip separator does not rapidly deteriorate because of wear and misalignment, a prominent problem of prior chip separators.

These and other objects, advantages and features of the present invention will become apparent upon review of the following specification in conjunction with the accompanying drawings.

DESCRIPTION OF THE PREFERRED EMBODIMENT

Figure 1:
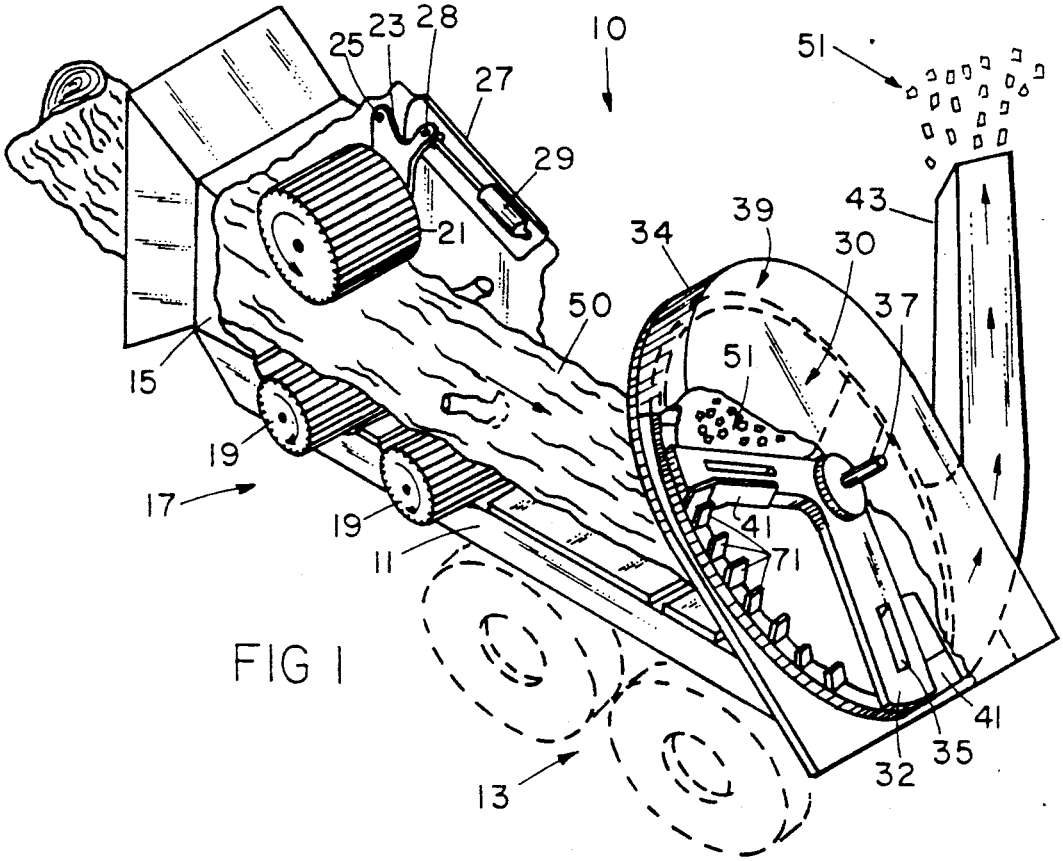
FIG. 1 is a fragmentary perspective view, partly broken away, of a portion of a wood chipping machine embodying the present invention.
Figure 7:
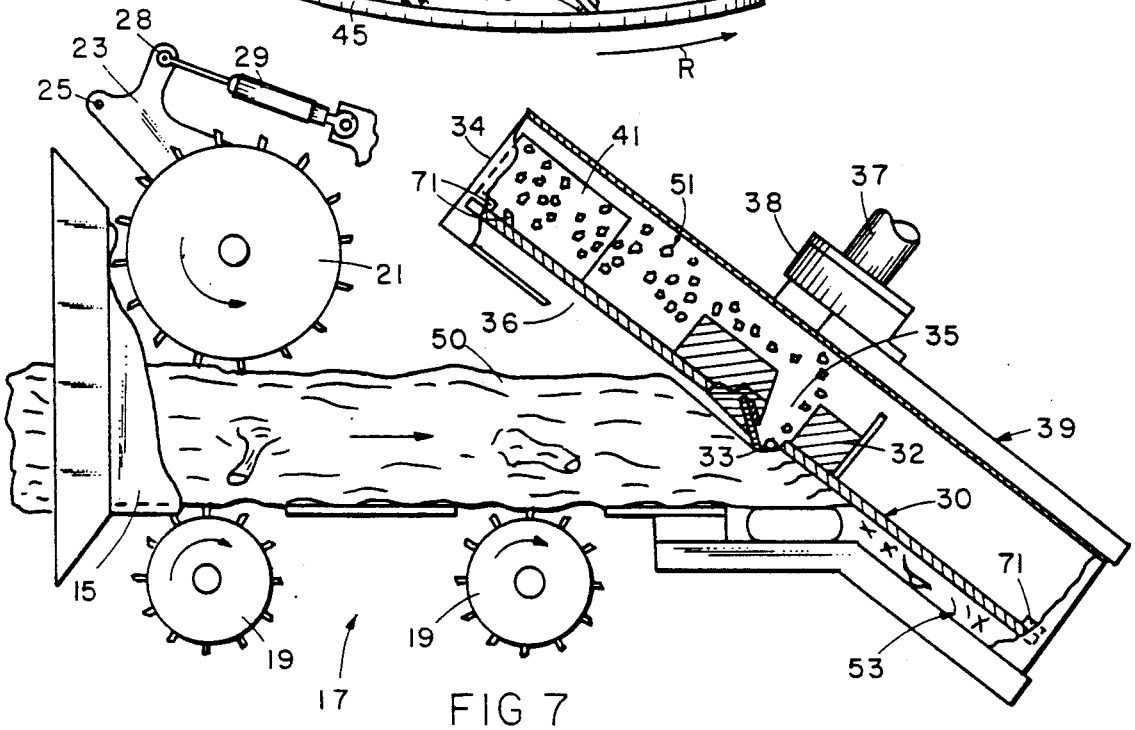
FIG. 7 is a fragmentary, partially broken away, side elevation view of a portion of a machine embodying a cutter disk shown in FIGS. 5 and 6.

Referring initially to FIGS. 1 and 7, a rotary wood chipper 10, embodying the present invention, is shown integrally constructed on a towing frame 11, including an axle, wheel and suspension assembly 13, for portability to a job site. Chipper 10 includes an infeed chute 15 and a powered material conveyor 17 for feeding material, typically a tree 50, into chipper 10. Conveyor 17 includes a pair of spaced powered lower rollers 19 and a powered upper roller 21. Rollers 19 are stationary in position, but rotate to carry tree 50 into chipper 10. Roller 21 is mounted to a carrier 23 which is pivotally mounted at pivot axle 25 to the chute housing 27 for lifting roller 21 substantially vertically, away from rollers 19, to accommodate different diameter trees. Carrier 23 is actuated by a double-acting hydraulic ram 29, having one end pivotally mounted to housing 27 and an opposite end coupled to actuating arm 28 of carrier 23. Ram 29 is normally in a float mode, allowing roller 21 to float upon tree 50. However, ram 29 can be engaged to rotate carrier 23 and pull roller 21 downwardly, toward rollers 19, to capture tree 50 between rollers 19 and roller 21. Conversely, ram 29 can also be engaged to rotate carrier 23 and lift roller 21 to accommodate a large tree. Conveyor 17 feeds tree 50 into a cutter housing 39, through an infeed opening 36 (FIG. 7), to the front side of a cutter disk assembly 30.

Figure 2:
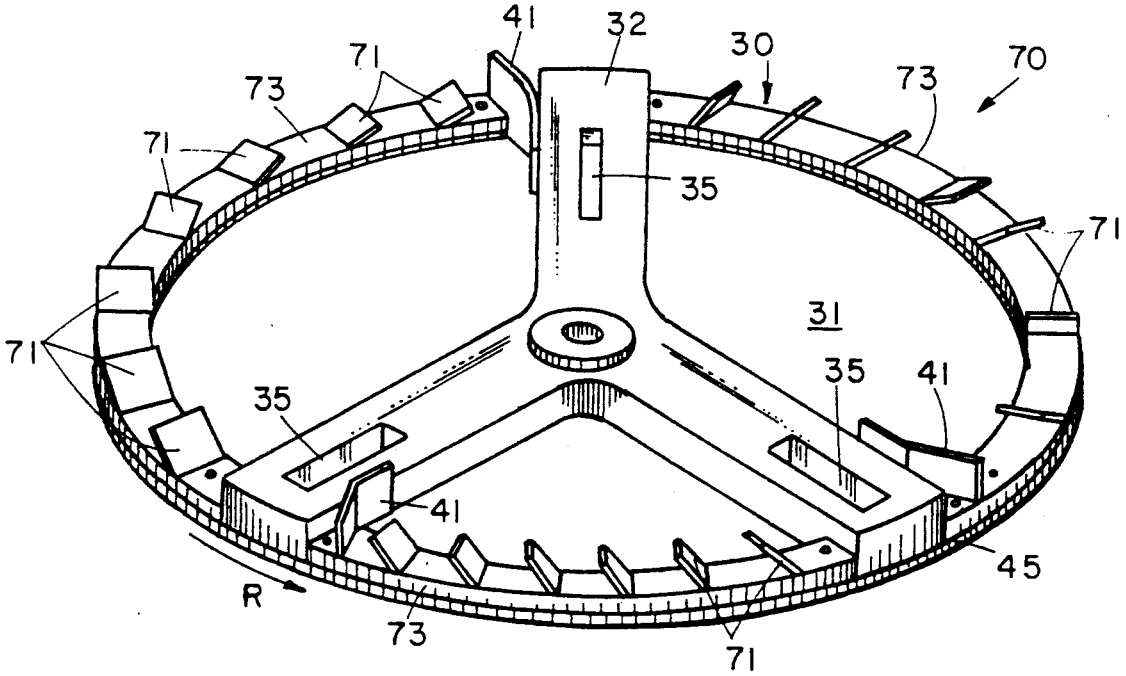
FIG. 2 is a perspective rear view of the cutter disk shown in FIG. 1.

The cutter disk assembly 30 is the heart of chipper 10 and includes a thick metal disk 31 with three equally spaced knives 33, conventionally mounted at an angle to the edge of chip slots 35. In the embodiment shown, the disk is reinforced by a three-legged, generally Y-shaped web 32 (FIGS. 1 and 2) through which chip slots 35 are formed. Power is supplied to a shaft 37 of cutter disk assembly 30, which is rotatably mounted in housing 39 by a suitable bearing assembly 38, for rotating the disk at relatively high speed. Housing 39 defines a generally cylindrical chamber with curved sidewalls 34 and a tangential discharge chute 43. Disk assembly 30 is mounted at an acute angle to the direction of feed, such that knives 33 tend to draw tree 50 into disk assembly 30. As tree 50 is fed into the front side of disk assembly 30, knives 33 slice the end of the tree to form chips 51 which pass through chip slots 35 to the back of disk assembly 30. While chips 51 move radially to the perimeter of disk assembly 30 in part by centripetal force, conventional fan blades 41 which are attached to the back of disk 31 induce an airflow which also moves the chips to the perimeter and which carries the chips through chip chute 43 for discharge from chipper 10. However, some materials, such as grit, leaves, needles and small branches, are not cut and remain on the front side of the disk where they are discarded as chaff 53 (FIG. 7). Having described the basic chipper construction, a description of the chip separator structure of the present invention is now presented in conjunction with FIGS. 2–6.

Figure 3:
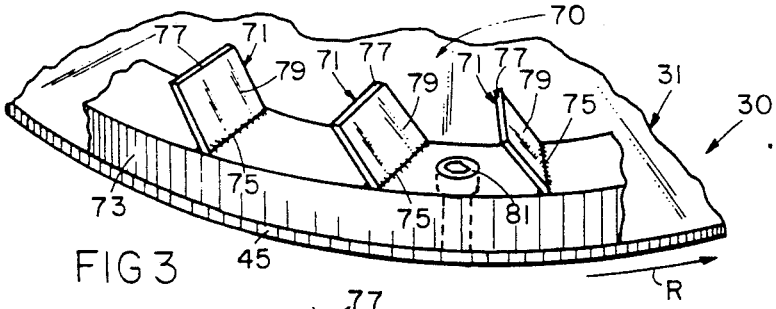
FIG. 3 is enlarged fragmentary perspective view of a portion of t disk shown in FIGS. 1 and 2.
Figure 4:
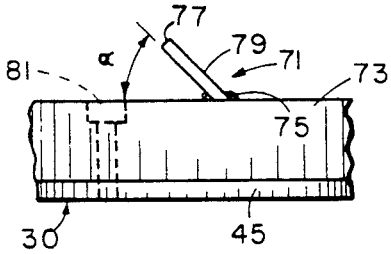
FIG. 4 is enlarged fragmentary side elevation view of a portion of the disk shown in FIG. 3.

The chip separator 70 (FIGS. 2 and 3) of the present invention includes a series of angled fins 71 which are welded in the preferred embodiment to three curved mounting bars 73, with one bar extending between adjacent legs of web 32 and bolted to disk 31 by a plurality of bolts 81. As shown in FIGS. 3 and 4, an edge 75 of each fin 71 is welded to a bar 73 with the fin projecting from the bar. Each of the mounting bars 73 is arcuately shaped to conform to the curved edge 45 of disk 31. Each fin 71 is preferably a 2" by 2" by ½" steel plate and extends the width of bar 73. Disk assembly 30 rotates in a direction indicated by arrow R in FIGS. 2, 3 and 5. While the invention can function with at least a pair of fins 71, spaced on each bar 73 in front of each fan blade 41, the invention is preferably practiced with seven fins 71, equally spaced along each bar 73, the fins can be set at an angle $\alpha$ (FIG. 4) relative to bar 73 in a range of from about 10° to 170° but preferably are set at about 45°.

Figure 6:
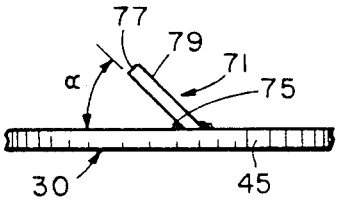
FIG. 6 is an enlarged fragmentary side elevation view of a portion of the disk shown in FIG. 5.
Figure 5:
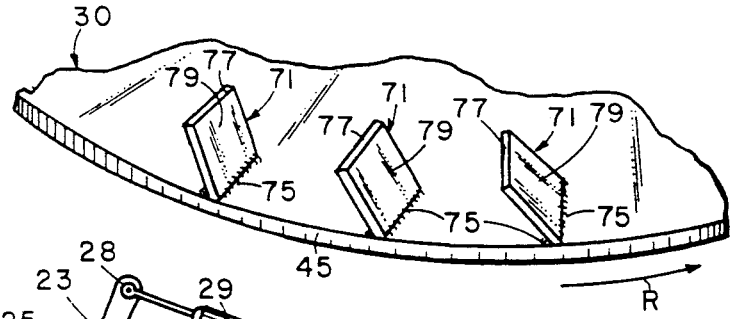
FIG. 5 fragmentary perspective view of an alternative embodiment of a cutter disk embodying the present invention.

In an alternative embodiment as shown in FIGS. 5 and 6, each fin 71 is welded directly to disk 31. In this embodiment, each fin edge 75 has its outer edge abutting edge 45 of disk 31.

In operation, centripetal force and the air current created by fan blades 41 tend to move chips 51 to the perimeter of disk 31 after passing through chip slots 35. In addition, the chips are deflected axially away from disk 31 before reaching disk edge 45 by fins 71, by impacting face 79 of a fin and in part by an axially flowing air current created by fins 71. Thus, chips 51 are substantially precluded from reaching the immediate vicinity of edge 45 of disk 31. As a result, the potential for a chip to pass around edge 45 to the front side of disk 31 is significantly decreased as is the loss of chips which would otherwise be discarded with chaff 53 (FIG. 2) and the efficiency of chipper 10 is increased.

Various modifications of the preferred embodiment of the invention will occur to those skilled in the art and will fall within the scope and spirit of this invention as defined by the appended claims.

The embodiments of the invention in which an exclusive property or privilege is claimed are defined as follows:

1. In a rotary wood chipper having a disk housing with a material infeed chute for receiving material into said chipper, said housing defining a substantially cylindrical chamber, having a cutter disk rotatably mounted in said housing chamber about an axis of rotation and having at least one knife which is mounted in a chip slot formed through said disk for cutting said material to form wood chips, said cutter disk having a front side into which material is fed for chipping and a back side located substantially on a plane and opposite said front side, said disk having an edge circumscribing said disk and extending between said front and said back, said housing further having a chip chute for discharging chips form said chipper and said chipper further having a plurality of fan blades for creating a circulation of air out through said chip chute for discharging chips from said chipper, the improvement comprising, in addition to said fan blades, chip deflection means mounted to said disk on said back side near said edge, said deflection means being arranged at an acute angle to said plane of said back side of said disk for deflecting wood chips in a direction along said axis of rotation of said disk away from said back side at the disk edge and therefore away from the space between said edge and said housing to minimize the number of chips passing over said edge to said front side of said disk.

2. The chip separator as defined in claim 1 wherein said chip deflection means comprises a plurality of fins mounted to said disk and projecting from said back side of said disk.

3. The chip separator as defined in claim 2 wherein each of said fins is a rectangular plate welded along one edge to said back side of said disk.

4. The chip separator as defined in claim 1 wherein said disk further includes mounting bar means mounted to said back side of said disk near said edge, said mounting bar means having a first flat surface for abutting said back side of said disk and having a second surface opposite thereto for receiving said chip deflection means and means for attaching said bar means to said disk.

5. The chip separator as defined in claim 4 wherein said mounting bar means comprises a plurality of curved bars.

6. The chip separator as defined in claim 5 wherein said chip deflection means comprises a plurality of fins and said fins are mounted to and project from said mounting bar means.

7. The chip separator as defined in claim 6 wherein each said fin is a rectangular plate welded along one edge to said mounting bar means.

8. The chip separator as defined in claim 7 wherein said curved bars are mounted to said back side of said disk by a plurality of bolts.

9. The chip separator as defined in claim 1 wherein said disk further includes mounting bar means mounted to said back side of said disk near said edge, said mounting bar means having a first flat surface for abutting said back side of said disk and having a second surface opposite thereto for receiving said chip deflection means and means for attaching said bar means to said disk and wherein said chip deflection means comprises a plurality of fins mounted to and projecting from said mounting bar means.

10. The chip separator as defined in claim 9 wherein each of said fins is a rectangular plate welded along one edge to said mounting bar means.

11. A wood chipping apparatus comprising:

a housing with an infeed aperture for receiving material to be chipped and a peripheral wall with a discharge chute for expelling chips therefrom; and a chipper disk element rotatably mounted within said housing about an axis of rotation and having a peripheral edge spaced closely adjacent said peripheral wall, said chipping element including front and rear surfaces, said rear surface being located substantially on a plane; at least one knife for cutting said material to form wood chips; a plurality of fan blades for inducing an air flow which assists in moving the chips to the peripheral edge of said chipper disk element and peripheral wall out through said discharge chute for expelling chips therefrom; said perimeter of said chipper disk element, because of lack of close tolerances or wear, being spaced from the perimeter of said housing providing a space therebetween through which chips can pass around said edge from said back side to said front side, as they are moved to the perimeter of said chipper disk element and housing by centrifugal force and said fan blades; and at least one knife aperture for mounting said knife and through which chips pass from said front to said rear of said chipper disk element; said chipper disk element further including chip deflecting means mounted to said rear surface and arranged at an acute angle from said plane of said rear surface for deflecting wood chips in a direction along said axis of rotation of said disk away from the rear surface of said chipper disk element and away from the space between said edge and said peripheral wall to minimize the number of said chips passing over said edge to said front surface of said chipper element.

12. The chip separator as defined in claim 11 wherein said chip deflecting means comprises a plurality of fins mounted to said disk and projecting from said rear.

13. The chip separator as defined in claim 12 wherein each said fin is a rectangular plate welded along one edge to said rear.

14. The chip separator as defined in claim 11 wherein said disk further includes mounting bar means mounted to said rear of said disk near said edge, said mounting bar means having a first flat surface for abutting said rear of said disk, having a second surface opposite thereto for receiving said chip deflecting means and means for attaching said bar means to said disk.

15. The chip separator as defined in claim 14 wherein said mounting bar means comprises a plurality of curved bars.

16. The chip separator as defined in claim 15 wherein said chip deflecting means comprises a plurality of fins mounted to and projecting from said mounting bar means.

17. The chip separator as defined in claim 16 wherein each said fin is a rectangular plate welded along one edge to said mounting bar means.

18. The chip separator as defined in claim 17 wherein said curved bars are mounted to said rear of said disk by a plurality of bolts.

19. The chip separator as defined in claim 11 wherein said disk further includes mounting bar means mounted to said rear of said disk near said edge, said mounting bar means having a first flat surface for abutting said rear of said disk, having a second surface opposite thereto for receiving said chip deflecting means and means for attaching said bar means to said disk and wherein said chip deflecting means comprises a plurality of fins mounted to and projecting from said mounting bar means.

20. The chip separator as defined in claim 19 wherein each said fin is a rectangular plate welded along one edge to said mounting bar means.

21. A wood chipping apparatus having a housing with an inner peripheral wall, a rotary chipper element rotatably mounted in said housing about an axis of rotation on a given plane, said chipper element having a peripheral edge spaced from asid inner wall thereby providing a space through which chips can pass and be discarded, said chipper element having knife means for cutting wood chips; at least one aperture at the periphery of said inner wall and chipper element through which wood chips pass during operation for discharge and collection of the same; means on the discharge side of said chipper element for moving chips to said aperture and for discharging chips from said housing through said one aperture, wherein the improvement comprises:

said chipper element including a plurality of spaced relatively short fins projecting near said peripheral edge of the said discharge side of said chipper element at an acute angle from said plane for urging chips in a direction along said axis of rotation away from the said discharge side and away from the space between said edge of said chipper element and said inner wall of said housing.

22. The chip separator as defined in claim 21 wherein each of said fins is a rectangular plate welded along one edge to said discharge side of said chipper element.

23. The chip separator as defined in claim 21 wherein said disk further includes mounting bar means mounted to said discharge side of said chipper element near said outer edge, said mounting bar means having a first flat surface for abutting said discharge side of said chipper element and having a second surface opposite thereto for receiving said fins and means for attaching said bar means to said disk.

24. The chip separator as defined in claim 23 wherein said mounting bar means comprises a plurality of curved bars.

25. The chip separator as defined in claim 24 wherein said fins are mounted to and projecting from said mounting bar means.

26. The chip separator as defined in claim 25 wherein each said fin is a rectangular plate welded along one edge to said mounting bar means.

27. The chip separator as defined in claim 26 wherein said curved bars are mounted to said discharge side of said chipper element by a plurality of bolts.

* * * * *

UNITED STATES PATENT AND TRADEMARK OFFICE

CERTIFICATE OF CORRECTION

PATENT NO. : 5,060,873

DATED : October 29, 1991

INVENTOR(S) : Donald E. Strong

It is certified that error appears in the above-identified patent and that said Letters Patent is hereby corrected as shown below:

Column 2, line 42:
"of t disk" should be -- of the cutter disk --.

Column 2, line 43:
After "is" insert -- an --.

Column 2, line 45:
After "FIG. 5" insert -- is a --.

Column 4, line 34:
"chips form" should be -- chips from --.

Column 6, line 27:
"asid inner" should be -- said inner --.

Signed and Sealed this

Eighth Day of June, 1993

Michael K. Kirk

*Attest:*

MICHAEL K. KIRK

*Attesting Officer*

*Acting Commissioner of Patents and Trademarks*